United States Patent [19]

Fischer

[11] 4,430,018

[45] Feb. 7, 1984

[54] END FITTING FOR OIL WELL SUCKER RODS

[75] Inventor: Carlin P. Fischer, Omaha, Nebr.

[73] Assignee: Technicraft, Inc., Omaha, Nebr.

[21] Appl. No.: 483,832

[22] Filed: Apr. 11, 1983

[51] Int. Cl.[3] ..... F16B 11/00

[52] U.S. Cl. ..... 403/268; 403/374

[58] Field of Search ..... 403/265, 266, 267, 268, 403/374

[56] References Cited

U.S. PATENT DOCUMENTS

| | | | |
|---|---|---|---|
| 4,205,926 | 6/1980 | Carlson | 403/266 |
| 4,297,787 | 11/1981 | Fischer | 33/144 |
| 4,315,699 | 2/1982 | Lusk | 403/361 |
| 4,360,288 | 11/1982 | Rutledge et al. | 403/267 X |

*Primary Examiner*—Andrew V. Kundrat

*Attorney, Agent, or Firm*—Zarley, McKee, Thomte, Voorhees & Sease

[57] ABSTRACT

An end fitting for a sucker rod for oil wells is described with the end fitting having a chamber portion extending inwardly from one end thereof and an externally threaded portion at its other end. The chamber portion is defined by a plurality of spaced-apart annular ridges which define frusto-conical shaped cavities therebetween. The end fitting also has a bore extending inwardly thereinto from its other end which communicates with the inner end of the chamber portion. A valve is mounted in the end fitting and has a valve stem positioned in the bore and a valve head positioned at the inner end of the chamber portion. The chamber portion is adapted to receive a glass reinforced resin bonded cylindrical rod which is maintained therein by a two-part epoxy resin which surrounds the rod and is received in the cavities to form epoxy wedges bonded to the rod. The outer end of the bore is provided with internal threads which threadably receive a screw therein which engages the end of the valve stem so that longitudinal force may be applied to the valve thereby transmitting longitudinal force to the end of the rod.

5 Claims, 3 Drawing Figures

END FITTING FOR OIL WELL SUCKER RODS

BACKGROUND OF THE INVENTION

Fiberglass sucker rod strings are becoming popular for use in producing oil wells since they may increase production over steel rod strings due to pump plunger over travel possibly because of higher elastic properties of the fiberglass reinforced plastic rods. Another desirable feature of the fiberglass sucker rod strings is that the overall weight of the string is reduced when compared to steel sucker rod strings. Still another advantage of the fiberglass rods are that they will not corrode.

In steel sucker rod strings, the steel sucker rods are screwed into threaded end fittings to enable the sucker rods tp be connected together in an end-to-end relationship. When fiberglass rods are used, it is not possible to threadably secure the fiberglass rods to the end fittings so an alternate connection means must be provided. One form of connecting a fiberglass rod to an end fitting is disclosed in my U.S. Pat. No. 4,297,787 which issued on Nov. 3, 1981. An end fitting specifically designed for fiberglass sucker rods is illustrated in U.S. Pat. No. 4,360,288. Still another means of securing a fiberglass rod to an end fitting is disclosed in U.S. Pat. No. 4,315,699.

In U.S. Pat. Nos. 4,297,787 and 4,315,699, an adhesive or epoxy resin material secures the fiberglass rod to the metal end fittings. It has been found that there can be a separation in the fiberglass rod from the end fitting due to failure of the epoxy bond within the compression fitting. The usual assembly procedure for bonding a fiberglass rod to a metal end fitting is as follows:

(a) Degrease the machined end fitting.

(b) Apply a mold release agent to prevent a bond between the epoxy and the metal of the end fitting.

(c) Bake the treated fittings to drive off solvents in the mold release agent to prevent an intermix of mold release and epoxy resin that can reduce or destroy the physical properties of the potting resin.

(d) Inject a two-part epoxy resin into the fitting and slowly place the fitting onto the end of an abraided fiberglass rod while the rod is being held at a 35° to 45° angle from the ground to prevent air-pocketing of the epoxy potting resin.

(e) Centralize the rod with a plastic ferrule by driving it in along and around the rod between the opening of the end fitting. The ferrule also serves as a retainer for the epoxy resin so that the long rods may be processed further in a horizontal position while preventing air pockets caused by "resin-loss".

(f) Thermally cure the epoxy potting resin by placing the assemblies in a curing oven which not only accomplishes a curing of the resin but also causes a desirable post-curing of that portion of the rod.

(g) Placing the rods in a suitable tensioning device to set the wedge or separating the bonded assembly from the metal interior surfaces and to start the compression forces perpendicular to the wedge angle.

Once the wedge has been set, the compression forces are started perpendicular to the angles formed with the steel end fitting. This process separates the bonded epoxy resin fiberglass rod portion approximately 1/16th of an inch to 3/32nd of an inch depending upon such things as the compressive strength of the rod, the distance between, or the clearance around (cushion) the fiberglass rod and the smallest diameter of the compression device, the compressive strength of the epoxy potting compound, the degree of wedge angle, the temperature, and the tensional force being applied.

The necessity for a multiplicity of angles is relative only with regard to improper degree of angle, choice of materials, or assembly technique. The use of more than one compression wedge angle or cavity becomes "fail-safe" only when the wedge angle cavity most removed from the tensile force is or has been improperly formed due to air pocketing or improper centralizing of the fiberglass rod with respect to the end fitting. The effect of improper centralizing of the rod is that unequal compression forces perpendicular to the wedge angle cause a cantilever point where a shear is applied to a rod with low shear resistance. A small percentage of the shear problems may be reduced by increasing the cushion distance. However, ultimate tensile failure does not occur to properly assembled parts with properly selected materials within the area of the compression angle most removed from the source of tension.

As long as proper lap shear strength is developed between the epoxy potting resin and the abraided fiberglass rod, and when the proper tension has been applied to set the wedge, the fiberglass rod will be held in compression sufficiently to make it useful to be joined end-to-end in a sucker rod string. The amount of compression to the fiberglass rod, after the initial force required to set the wedge is applied, will vary directly with the subsequent reciprocating tension, and most importantly, temperature. The epoxy wedge around the fiberglass rod will remain in compression as long as the formed assembly is in repose and as long as the working stresses are kept within the elastic working region of the fiberglass rod. When the fiberglass sucker rod strings are allowed to undergo compression, the wedges unseat or become loose and will work free. The reciprocating tension causes a movement and a wearing away of the epoxy resin which can unevenly alter the compression sufficient to cause an increased cantilever effect and resulting shear. The wear can also be sufficient to cause a release of the rod or "pull out". A wearing away of the potting resin can also increase the amount of compression upon the rod sufficient to crush the rod. The motion of the parts opposed to one another can also cause a delamination of a layer of fibers on the rod thereby causing a release of the potting resin and an eventual "pull out".

Therefore, it is a principal object of the invention to provide an improved end fitting for oil well sucker rods.

A further object of the invention is to provide an end fitting for oil well sucker rods which reduces or eliminates the likelihood of pull outs, shears or bond failures by preventing movement of the epoxy wedge system.

A further object of the invention is to provide an end fitting for oil well sucker rods including means for initially applying a longitudinal force on the end of the fiberglass rod within the end fitting.

Still another object of the invention is to provide an end fitting for an oil well sucker rod including an aperture which may be used to flood coolant therethrough while the interior configuration is being machined.

Still another object of the invention is to provide an end fitting for an oil well sucker rod which includes means for preventing movement of the wedge system within the end fitting.

Still another object of the invention is to provide an end fitting for an oil well sucker rod which substantially increases the compressive strength of the fiberglass rod.

Still another object of the invention is to provide an end fitting for an oil well sucker rod which is durable in use.

These and other objects will be apparent to those skilled in the art.

SUMMARY OF THE INVENTION

Figure 1:
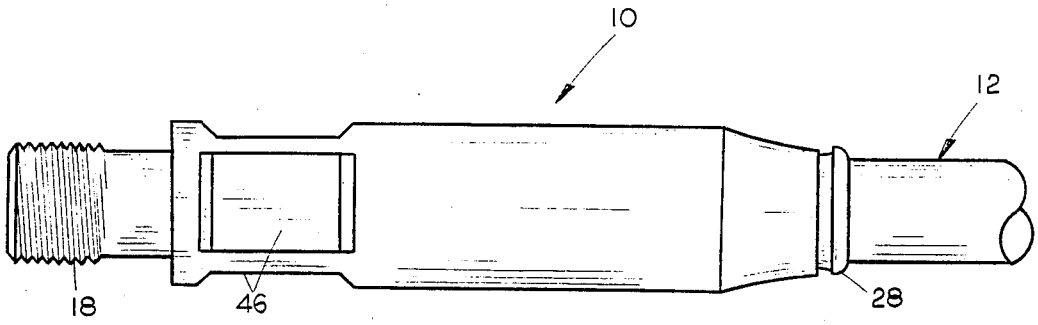
FIG. 1 is a plan view of the end fitting of this invention.

An end fitting for an oil well sucker rod is described having an externally threaded portion at one thereof and an open rod receiving portion at its other end. The end fitting has a chamber portion extending inwardly from its other end for receiving one end of a cylindrical fiberglass rod. The chamber portion is defined by a plurality of spaced-apart annular ridges defining frusto-conical shaped cavities therebetween. The end fitting has a bore formed therein which extends inwardly from its one end to the chamber portion. A valve is mounted in the end fitting and is comprised of a valve stem portion positioned in the bore and a valve head on one end thereof which is positioned in the inner end of a chamber portion. The outer end of the bore is provided with internal threads adapted to receive a screw therein. After one end of the rod and the epoxy have been introduced into the chamber, the screw is moved inwardly in its threaded bore to force the valve head of the valve against the inner end of the rod until approximately forty foot pounds of pressure is applied to the set screw. The component parts are then allowed to cool which results in a backload being applied to the rod and the wedge system to prevent subsequent failure of the end fitting.

DESCRIPTION OF THE PREFERRED EMBODIMENT

The numeral 10 refers to the end fitting of this invention while the numeral 12 refers to a cylindrical fiberglass reinforced plastic rod. For purposes of description, end fitting 10 will be described as including ends 14 and 16. End fitting 10 is provided with an externally threaded portion 18 at end 14 and a chamber portion 20 which extends inwardly from end 16. Chamber portion 20 is defined by a plurality of spaced-apart annular ridges 22 which define frusto-conical shaped cavities 24 therebetween. The inner end of chamber 20 is provided with a cylindrical portion 26 which is adapted to receive one end of the rod 12. The numeral 28 refers to a plastic ferrule adapted to extend around the rod 12 as illustrated and adapted to be received by the outer end of the chamber 20 to maintain the epoxy within the chamber 20 while the epoxy is still in a liquid state and to centralize the rod 12 with respect to the interior wall surface of the chamber portion.

End fitting 10 is provided with a bore 30 formed therein which extends inwardly from end 14 to inner end of chamber portion 20. The inner end of bore 30 is tapered outwardly at 32 to communicate with the inner end of cylindrical portion 26 of chamber 20. Bore 32 is provided with an internal threaded portion 34 which is adapted to receive screw 36. The numeral 38 refers to a valve comprising a valve stem 40 and a valve head 42. Valve head 42 has an O-ring 44 provided thereon which preferably has a durometer hardness of 90. O-ring 44 is preferably comprised of a fluoroelastomer material such as Viton TM sold by E. I. dePont to enable the O-ring to sustain temperatures up to 400°-450° F. End fitting 10 is also provided with wrench "flats" 46 on its exterior surface.

The end fitting 10 is constructed of steel material and the bore 30 is initially created in the end fitting. The chamber 20 is then machined to form the interior configuration thereof. At this time, the bore 30 provides an aperture for flooding coolant through the receiving end of the fitting while the interior configuration of the chamber 20 is being machined. The flooding of the chamber portion 20 removes or chases the machine chips from the interior of the chamber 20 so that they do not gall the surfaces by being remachined which does cause tool breakage and excessive wear. The fact that the machine chips are also flooded from the chamber 20 during the machining thereof, also enables increased feeds and speeds. A further advantage of the ability to flood the machined chips from chamber 20 is that a much smoother interior surface is provided thereby eliminating the need for applying a mold release agent to the interior surface of the chamber 20.

Figure 2:
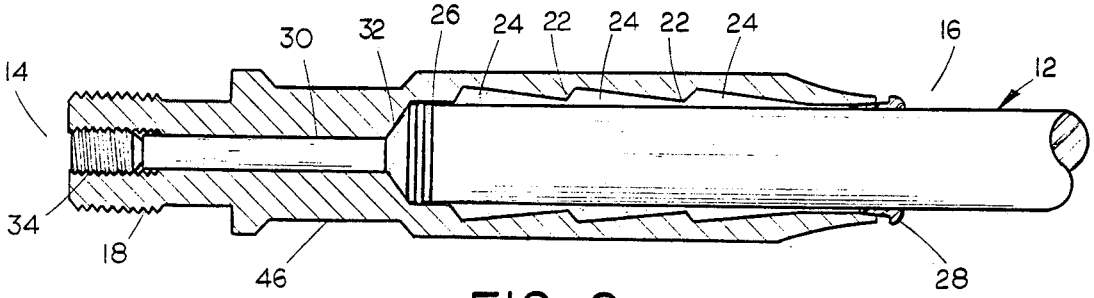
FIG. 2 is a longitudinal sectional view of the end fitting.
Figure 3:
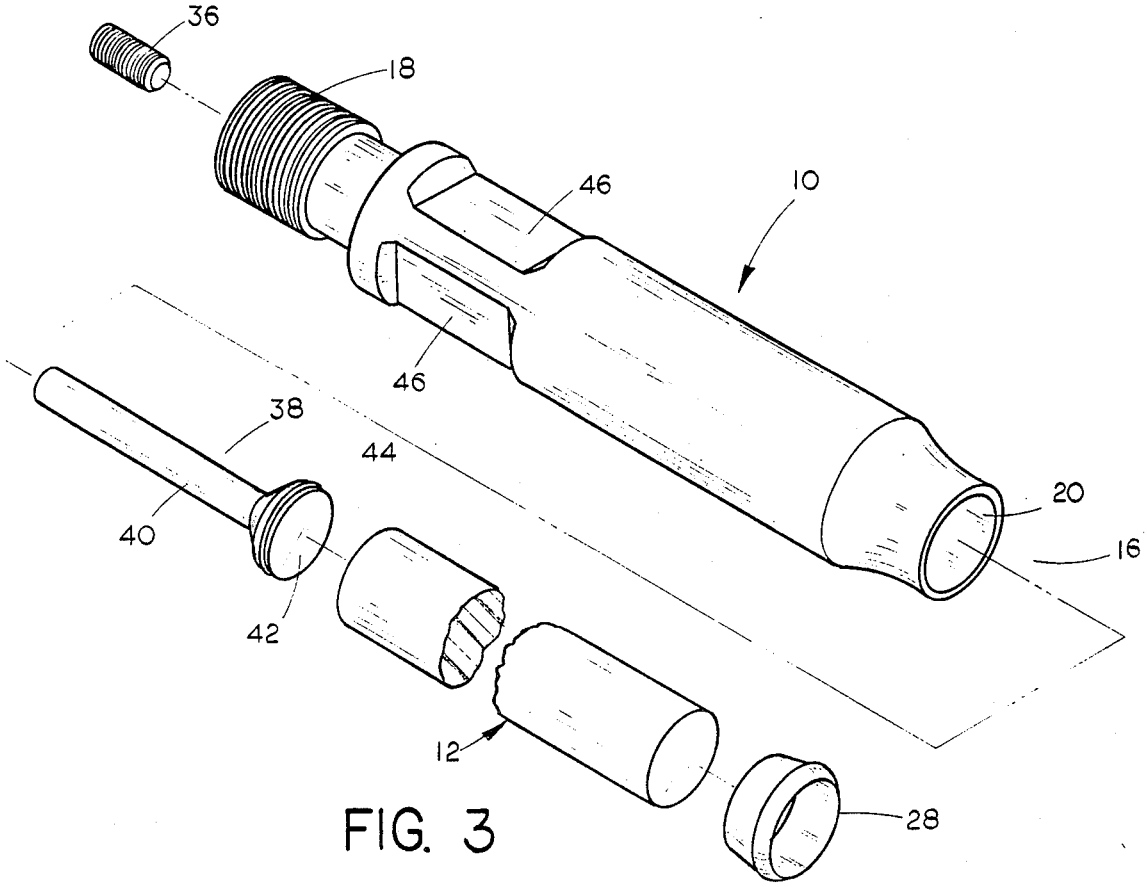
FIG. 3 is an exploded perspective view of the end fitting of this invention.

The valve 38 is then inserted into the end fitting from end 16 so that the valve stem 40 is positioned in bore 30 and so that head 42 is positioned as illustrated in FIG. 2. The O-ring 44 engages the interior wall surfaces of cylindrical portion 26 to prevent the epoxy subsequently introduced into chamber 20 from entering bore 30. The end fitting is then degreased and baked.

A two-part epoxy resin is then poured into the chamber 20 and the fitting is placed onto the end of the rod 12 while the rod is being held at a 35° to 45° angle from the ground to prevent "air pocketing" of the epoxy potting resin. The rod is then centralized by driving the ferrule 28 in, along and around the rod between the opening of the end fitting as illustrated in FIG. 2. The ferrule 28 also serves as a retainer for the epoxy resin so that the rods may be processed further in a horizontal position further preventing air pockets caused by resin-loss. The epoxy resin is then thermally cured by placing the assemblies in a curing oven which not only cures the resin but also effects a desirable post-curing of that portion of the rod. The curing schedule for the Hardman Company Adhesive No. X13356 and 8279 is two hours at 160° F. and then four hours at 300° F. The rods are then placed in a suitable tensioning device to set the wedge while the resin is still above 160° F.

Prior to the components being cooled, the screw 36 is threaded into the bore 34 so that the inner end thereof engages the outer end of valve stem 40 and torque is applied to the screw until a value of approximately forty foot pounds is achieved. The torquing of the screw 36 moves the valve head 42 up against the base of the fiberglass rod 12. As the resin, rod and end fitting cool, shrinkage causes a desirable "backload" upon valve stem 40 and set screw 36 further insuring repose of the wedge system. It is recommended that a Permatex lock nut material be applied to the screw 34 to prevent it from backing-off.

In use, the end fitting insures that the rod will be held in compression sufficiently to prevent separation thereof. The epoxy wedge around the fiberglass rod remains in compression due to the force of the valve 38 against the inner end of the rod 12 thereby insuring that the epoxy wedges will not excessively wear which could cause subsequent failure of the assembly.

Thus it can be seen that a novel end fitting has been provided for use with oil well sucker rods which achieves all of the stated objectives.

I claim:

1. A sucker rod for oil wells, comprising:

an end fitting having an externally threaded first end and an open rod receiving second end, said end fitting having a chamber portion extending inwardly from said second end for receiving one end of a cylindrical rod, said chamber portion being defined by a plurality of spacedapart annular ridges defining frusto-conical shaped cavities therebetween, said end fitting having a central bore formed therein extending inwardly from said first end to said chamber portion, a fiberglass cylindrical rod having one end positioned in said chamber portion, an adhesive means bonded to said one end of said rod and received by said cavities to maintain said rod in said chamber portion, a valve in said end fitting comprising an elongated valve stem portion positioned in at least a portion of the length of said bore, and a valve head on one end of said stem portion which is positioned in the inner end of said chamber portion, said central bore having an internally threaded outer end portion, a screw means threadably mounted in said internally threaded portion adapted to engage the other end of said valve stem portion to forceably move said valve away from said first end against the inner end of the cylindrical rod in said chamber portion.

2. The sucker rod claim 1 wherein a ferrule embraces said rod in the outer end of said chamber portion to centralize said rod with respect thereto.

3. The sucker rod of claim 2 wherein said ferrule sealably engages said rod and said end fitting to prevent the adhesive means, when liquid, from escaping from said chamber portion.

4. The sucker rod of claim 1 wherein said adhesive means comprises a two-part epoxy resin material.

5. The sucker rod of claim 1 wherein said valve head prevents the adhesive means, when liquid, from flowing from said chamber portion into said central bore.

* * * * *